United States Patent [19]

Streng

[11] Patent Number: 4,799,265

[45] Date of Patent: Jan. 17, 1989

[54] ELECTROSTATIC TRANSDUCER UNIT

[75] Inventor: Johannes H. Streng, Eindhoven, Netherlands

[73] Assignee: U.S. Philips Corporation, New York, N.Y.

[21] Appl. No.: 68,868

[22] Filed: Jul. 1, 1987

[30] Foreign Application Priority Data

Jul. 8, 1986 [NL] Netherlands ..... 8601772

[51] Int. Cl.[4] ..... H04R 3/00

[52] U.S. Cl. ..... 381/116; 381/191

[58] Field of Search ..... 381/116, 24, 190, 191

[56] References Cited

U.S. PATENT DOCUMENTS

| | | | |
|---|---|---|---|
| 3,008,011 | 11/1961 | Williamson et al. . | |
| 3,008,013 | 11/1961 | Williamson et al. . | |
| 3,136,867 | 6/1964 | Brettell | 381/116 |
| 3,892,927 | 7/1975 | Lindenberg | 381/116 |
| 3,895,193 | 7/1975 | Bobb | 381/116 |
| 3,992,585 | 11/1976 | Turner et al. | 381/116 |
| 4,122,302 | 10/1978 | Bobb | 381/159 |
| 4,233,472 | 11/1980 | Kleis | 381/98 |
| 4,289,936 | 9/1981 | Civitello | 381/116 |
| 4,515,997 | 5/1985 | Stinger, Jr. | 381/190 |

FOREIGN PATENT DOCUMENTS 1228775 4/1971 United Kingdom .

*Primary Examiner*—Forester W. Isen

*Attorney, Agent, or Firm*—Bernard Franzblau

[57] ABSTRACT

A device for converting an electric signal into an acoustic signal comprises an input terminal (1) for receiving an electric signal, an amplifier unit comprising N sub-amplifiers (13,15), and a transducer unit comprising N electrostatic transducers (2,3). The diaphragm (3,8) of the N electrostatic transducers forms part of a diaphragm which is common to all transducers. The input terminal (1) is coupled to the input (6) of the first transducer (2) via a first subamplifier (13). Further, the input terminal (1) is coupled to the input (11) of the (i+1)th transducer, i ranging from 1 to N−1 inclusive, via a series arrangement of an i-th low-pass filter (14) and an (i+1)th sub-amplifier (15) (in that order). The sub-amplifier is moreover of the feedback type. Further, for N>2 a low-pass filter having a higher sequence number i has a lower cut-off frequency.

9 Claims, 2 Drawing Sheets

ELECTROSTATIC TRANSDUCER UNIT

BACKGROUND OF THE INVENTION

The invention relates to a device for converting an electric signal into an acoustic signal, comprising an input terminal for receiving the electric signal, an amplifier unit having an input coupled to the input terminal, and an output, and an electrostatic transducer unit coupled to the output of the amplifier unit, the electrostatic transducer unit comprising N electrostatic transducers, N being larger than or equal to 2. Such a device is known from German Offenlegungsschrift No. 1,762,375.

Electrostatic loudspeakers are known in a construction of a first type comprising, a diaphragm in the form of a foil on which an electrode is arranged, and a stationary second electrode which is spaced from the diaphragm.

A construction of a second type is the push-pull loudspeaker. This construction employs two stationary electrodes arranged at a specific distance on opposite sides of the diaphragm. The electrode arranged on the diaphragm may be a vacuum-deposited conductor layer of, for example, aluminum However, it is alternatively possible to provide an electrode in the form of a high-impedance layer on the diaphragm, so that less distortion is produced than in the case of a low-impedance layer, see German patent specification No. 1,088,546.

For a high sensitivity of the loudspeaker the diaphragm and the stationary electrode(s) must be arranged at a small distance from each other. However, the surface area of the diaphragm is then required to be large in order to achieve an adequate low-frequency acoustic radiation of the loudspeaker When the loudspeaker has a large radiation surface this gives rise to the problem of acoustic waves radiated at higher frequencies being concentrated.

This may be solved by reducing the dimensions of the effective radiation surface at increasing frequencies. This solution is known per se and is employed in a column comprising a plurality of loudspeakers arranged one above the other, see U.S. Pat. No. 4,233,472.

SUMMARY OF THE INVENTION

It is an object of the invention to provide a device comprising an electrostatic transducer unit which has a large radiation angle at high frequencies, while maintaining the advantages of a high acoustic radiation at low frequencies and a high sensitivity.

To this end the device in accordance with the invention is characterized in that the diaphragms of the N electrostatic transducers form part of a diaphragm which is common to all transducers, in that the amplifier unit comprises N sub-amplifiers, in that the input terminal is coupled to an input of the first electrostatic transducer via a first sub-amplifier, the input terminal is coupled to an input of the $(i+1)$th electrostatic transducer via a series arrangement of an i-th low-pass filter and an $(i+1)$th subamplifier (in this order), which $(i+1)$th sub-amplifier is of the feedback type, i ranging from 1 to $N-1$ inclusive, and in that if $N>2$ a low-pass filter of a higher sequence number i has a lower cut-off frequency. The invention is based on the recognition of the following fact.

To solve the radiation problem it may be considered to utilize mechanical clamping for parts of the diaphragm, so that in fact a number of separate loudspeakers are formed. This has the disadvantage that at low frequencies the average excursion of the total common diaphragm surface is smaller than in the absence of clamping. This means that, in effect, the low frequency radiation is reduced.

The use of feedback amplifiers enables mechanical clamping to be dispensed with. Clamping is now realised electrically in the following manner.

If the frequency of the input signal is lower than the cut-off frequency of a specific low-pass filter, the associated sub-amplifier receives a signal and the associated loudspeaker is driven. For frequencies above of the associated sub-amplifier does not receive a signal or a signal equal to zero. Since the first sub-amplifier does not have a low-pass filter and any further sub-amplifiers have associated low-pass filters with a cut-off frequency higher than of, the diaphragm and consequently the diaphragm section associated with the relevant loudspeaker will still be driven and (tend to) make an excursion. The relevant amplifier tends to reduce the excursion of the diaphragm section by damping via the feedback. Thus, in fact a self-controlling electrical (more or less ideal) clamping of a diaphragm section is achieved.

In the case of inadequate damping the damping can be further increased by taking additional steps, so that an even better result can be achieved, as will be explained hereinafter.

It is obvious that the step in accordance with the invention may be applied to transducers of the first type but also to devices comprising transducers of the second type. In the latter case the transducers are each provided with the said input and a second input, and the device is characterized in that the input terminal is coupled to the second input of the first electrostatic transducer via an $(N+1)$th sub-amplifier, the gain factor in the circuit from the input terminal to the first input of the first transducer being substantially equal in magnitude to the gain factor in the circuit from the input terminal to the second input of the first transducer but having an opposite sign, in that the input terminal is coupled to the second input of the $(j+1)$th electrostatic transducer via a series arrangement of an $(N-1+j)$th low-pass filter and an $(N+1+j)$th sub-amplifier (in this order), which $(N+1+j)$th sub-amplifier is of the feedback type, the gain factor in the circuit from the input terminal to the first input of the $(j+1)$th transducer being substantially equal in magnitude to the gain factor of the circuit from the input terminal to the second input of the $(j+1)$th transducer but having an opposite sign, j ranging from 1 to $N-1$ inclusive.

The advantage of the inventive step resides in the fact that the required clamping of the diaphragm to reduce the radiation surface is achieved without mechanical contact with the diaphragm, so that the radiated low-frequency power is not affected.

The device comprising transducers of the second type may be characterized further in that an inverting element is arranged in each of the circuits from the input terminal to the second inputs of the transducers. The inverting elements may be arranged before the $(N+1)$th to 2N th sub-amplifier. In particular if the sub-amplifiers are high-voltage amplifiers, this has the advantage that the inverting elements can operate at a low voltage and can therefore be of simpler construction.

Another advantage of the use of high-voltage amplifiers is that the electric currents to be supplied by these amplifiers for driving the transducers can be much smaller than in the case where the transducers would be driven by low-voltage amplifiers (followed by a transformer with a specific winding ratio). The use of high-voltage amplifiers therefore enables dissipation problems to be mitigated.

Alternatively, the device comprising transducers of the second type may be characterized in that the (N+1)th subamplifier is the first sub-amplifier, in that the output of the first sub-amplifier is coupled to the second input of the first transducer via the inverting element, in that the (N+1+j)th sub-amplifier is the (1+j)th sub-amplifier, and in that the output of the (1+j)th sub-amplifier is coupled to the second input of the (1+j)th transducer via the inverting element. In this case only N sub-amplifiers are needed for driving the N transducers of the push-pull type.

If, as already stated above, the damping should still be inadequate, a number of steps may be taken to improve the result.

As a result of the feedback sub-amplifiers the voltage on the electrodes of the associated transducer is reduced to zero for frequencies above the cut-off frequency of the associated low-pass filter. This does not always mean that the excursion of the diaphragm becomes zero. This is because even in the case of zero voltage on the electrodes charge migrations over the electrodes may occur. A charge migration at zero voltage automatically leads to an excursion of the diaphragm and vice versa.

To obtain a further reduction of such charge migrations the following steps may be considered.

A first step is to modify the associated low-pass filter in such a way that in the frequency range (just) above the cut-off frequency of the filter, nevertheless a signal (though small) is applied to the associated sub-amplifier, which signal must be in phase opposition to the signal generated by the moving diaphragm.

Another step is to detect excursions of the diaphragm at frequencies above the cut-off frequency of the filter (which may be effected by utilising a portion of the electrode as the detector) and applying additional negative feedback (known as motional feedback) to the input of the associated sub-amplifier.

BRIEF DESCRIPTION OF THE DRAWINGS

Embodiments of the invention will now be described in more detail, by way of example, with reference to the accompanying drawings. In the drawings

DESCRIPTION OF THE PREFERRED EMBODIMENTS

Figure 1:
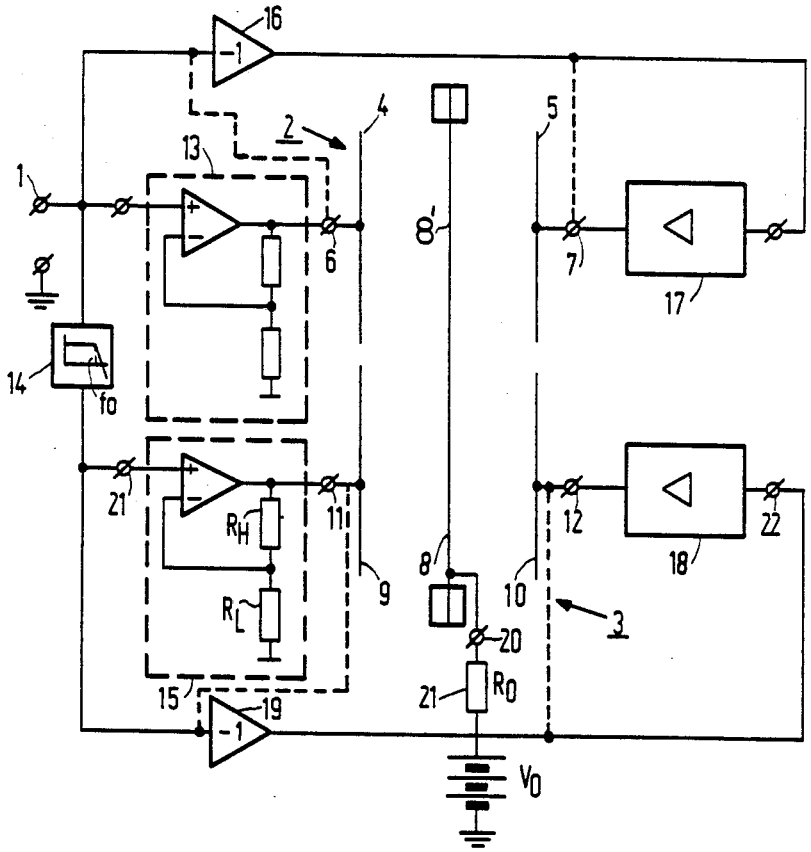
FIG. 1 shows a first and FIG. 2 shows a second embodiment of the device in accordance with the invention.

FIG. 1 shows a first embodiment of the device, comprising an input terminal 1 for receiving the electric signal and comprising an electrostatic transducer unit with (N=)2 electrostatic transducers. One electrostatic transducer 2 is of the push-pull type having a diaphragm 8', for example in the form of a foil on which a first electrode is arranged, and two stationary electrodes 4 and 5 each arranged at one side of the diaphragm 8'. The stationary electrodes 4 and 5 are electrically coupled to a first input 6 and a second input 7 respectively. The second transducer 3 is also of the push-pull type and comprises a diaphragm 8, for example in the form of a foil on which a first electrode is arranged, and two stationary electrodes 9 and 10 each at one side of the diaphragm 8. The electrodes 9 and 10 are electrically coupled to inputs 11 and 12 respectively.

The input terminal 1 is coupled to the input 6 of the first transducer 2 via a first sub-amplifier 13. The input terminal 1 is further coupled to the input 11 of the second transducer 3 via a first low-pass filter 14 and a second sub-amplifier 15 (in this order). Moreover, the input terminal 1 is coupled to the input 7 of the first transducer via a series arrangement of an inverting element 16 and a third sub-amplifier 17 and to the input 12 of the second transducer 3 via the low-pass filter 14 and a fourth sub-amplifier 18 (in this order) and via an inverting element 19. The sub-amplifiers 15 and 18 are feedback amplifiers having equal gain factors. The sub-amplifier 15 is shown in more detail and exhibits feedback via the impedances $R_H$ and $R_L$.

The sub-amplifiers 13 and 17 may also be feedback amplifiers having equal gain factors. The diaphragms 8 and 8' form part of a diaphragm which is common to both transducers, the first electrodes of both transducers arranged on the common diaphragm being electrically interconnected and being coupled to a point 20 of constant potential. This point is coupled to ground via a resistor 21 and a direct voltage source Vo which serves for charging the electrode of the diaphragm. The stationary electrodes 4, 5 and 9, 10 are provided with perforations enabling the passage of the acoustic waves radiated by the diaphragm 8, 8' when an electric signal is applied to the terminals 6, 7 and 11, 12.

As stated above, it is essential that the low-pass filter 14 precedes the feedback amplifiers 15 and 18. The device operates as follows.

An electric signal of a frequency below the cut-off frequency of the low-pass filter 15 is applied to the input terminal 1 and is amplified by the sub-amplifiers 13, 17, 15 and 18, after which it is applied to the respective inputs 6, 7, 11 and 12. This causes both diaphragms 8 and 8' to vibrate, which means that for this (low) frequency the entire common diaphragm contributes to the acoustic radiation.

An electric signal of a frequency higher than of will be applied only to the sub-amplifiers 13 and 17. This means that the diaphragm 8' is caused to vibrate. The vibrating diaphragm 8' obviously excites the diaphragm 8, so that this part of the common diaphragm also vibrates. This gives rise to an electric signal on the electrodes 9 and 10, which signals are suppressed by the feedback amplifiers 15 and 18 whose respective inputs 21 and 22 receive a signal equal to zero. Thus, the amplifiers 15 and 18 ensure that the voltages on the electrodes 9 and 10 respectively become (substantially) equal to zero. This results in the vibrations of the diaphragm 8 being damped, ensuring that the average excursion of the part 8 of the common diaphragm is (substantially) equal to zero. Thus, the diaphragm 8 is clamped-in electrically.

The inverting elements 16 and 19 may be arranged after the sub-amplifiers 17 and 18 respectively. In such a case the outputs 6 and 11 of the sub-amplifiers 13 and 15 may be coupled directly to the inputs 7 and 12 respectively by the inverting elements 16 and 19 respectively. This means that two sub-amplifiers, namely the sub-amplifiers 17 and 18, may be dispensed with.

In the case where the sub-amplifiers, such as the sub-amplifiers 17 and 18, are high-voltage amplifiers it is advisable to arrange the inverting elements 16 and 19 before the sub-amplifiers 17 and 18. The inverting elements 16 and 19 then have to handle low-voltage signals, so that they can be of simpler construction than in the case where they are arranged after the sub-amplifiers 17 and 18 and have to handle high-voltage signals.

The diaphragm 8, 8' in the embodiment shown in FIG. 1 may alternatively be driven in a manner as described with reference to FIG. 1 of German Patent Specification No. DE PS 1,088,546.

Alternatively, the embodiment shown in FIG. 1 may be provided with transducers of the first type (i.e. transducers of the one-sided construction). In that case the electrodes 5 and 10, amplifiers 17 and 18 and the inverting elements 16 and 19 are dispensed with.

The following steps may be applied to achieve an even better damping of vibrations of the diaphragm of the transducer 3.

A series arrangement comprising a band-pass filter and a phase inverter may be arranged in parallel with the low-pass filter 14. The band-pass filter has a low cut-off frequency situated at approximately $f_o$. Consequently, the band-pass filter transmits signals in a frequency range (just) above $f_o$. The phase inverter is now adjusted in such a way that the sub-amplifier 15 receives a signal which is in phase opposition to the signal produced on the electrodes as a result of vibrations of the diaphragm which are not yet adequately damped. This results in a further reduction of the signals and consequently a further reduction (damping) of the vibrations of the diaphragm of the transducer 3.

Another possibility is to insulate a part of, for example, the electrode 9 from the other part of the electrode 9 and to employ this part as a vibration detector. The signal taken from this part of the electrode is a measure of the vibrations of the diaphragm of the transducer 3 and after amplification or attenuation and filtering in a high-pass filter with a cut-off frequency $f_o$ it is applied to the input 22 of the sub-amplifier 18 and, applied in phase opposition to the input 21 of the sub-amplifier 15 (motional feedback).

Figure 2:
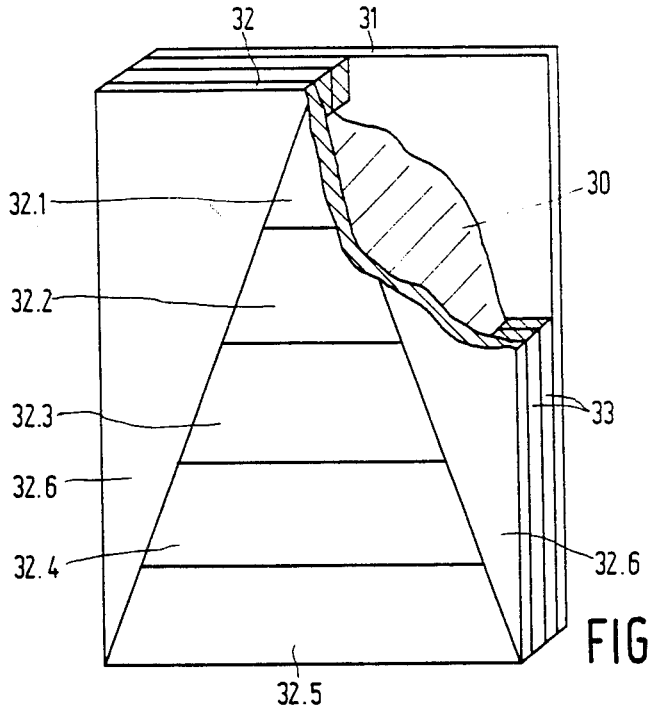
Figure 3:
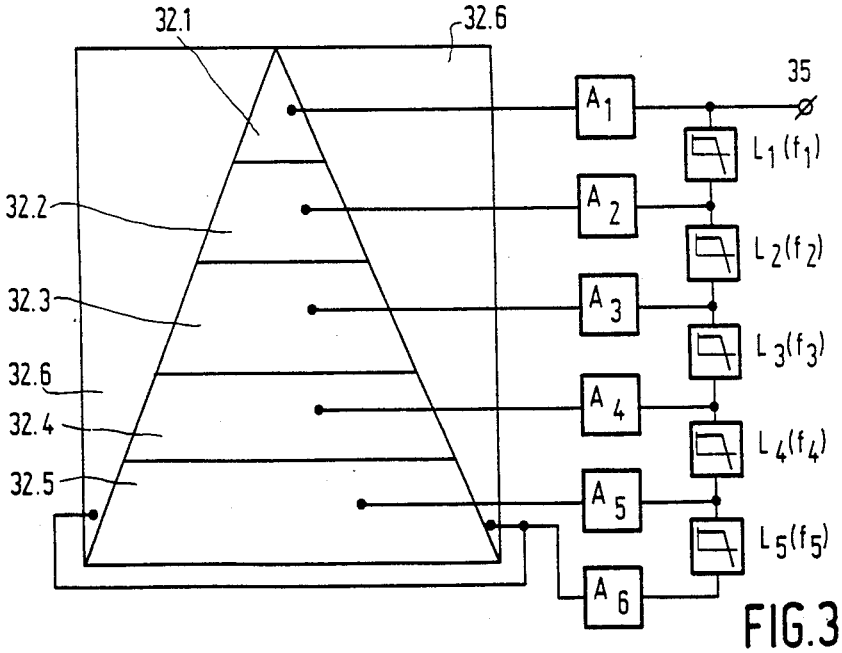
Figure 3 shows the electrical and the electrode configuration used in the embodiment shown in FIG. 2.

FIGS. 2 and 3 show a second embodiment. FIG. 2 is a partly cut-away view of a transducer unit and FIG. 3 shows a part of the amplifier unit, namely that part required for driving the stationary electrodes of the transducers situated at one side of the diaphragm which is common to the transducers.

FIG. 2 shows the transducer unit comprising a diaphragm 30 which is common to all transducers and which is constructed as a foil provided with a first electrode which is also common to all these transducers. Stationary electrodes 31 and 32 are arranged at opposite sides of the diaphragm. The stationary electrodes are divided into subelectrodes which are electrically insulated from each other. This is illustrated for the electrode 32. The electrode 32 comprises the triangular sub-electrodes 32.6 (twice) and 32.1. Further, the electrode 32 comprises the trapezoidal sub-electrodes 32.2 to 32.5. The electrode 31 is divided in a similar way. The two electrodes 31 and 32 are perforated. The diaphragm 30 is clamped in by means of the clamping frame 33.

FIG. 3 shows the circuit diagram for the circuit for driving the sub-electrodes 32.1 to 32.6. The input terminal 35 is coupled to the sub-electrodes 32.1 via the sub-amplifier $A_1$, which may be of the feedback type. The input terminal 35 is coupled to the sub-electrode 32.2 via the first low-pass filter $L_1$ having a cut-off frequency $f_1$ and via the sub-amplifier $A_2$ (in this order), which sub-amplifier $A_2$ is of the feedback type. The output of the low-pass filter $L_1$ is coupled to the sub-electrode 32.3 via a second low-pass filter $L_2$ having a cut-off frequency $f_2$ and a third sub-amplifier $A_3$ (in this order), which sub-amplifier $A_3$ is of the feedback type. The cut-off frequency $f_2$ is lower than the cut-off frequency $f_1$.

In the same way the input terminal 35 is coupled to a sub-electrode with a higher sequence number 32.i via a low-pass filter L with a higher sequence number i and a feedback sub-amplifier A with a higher sequence number i+1, in this order, the cut-off frequency $f_i$ of a low-pass filter with a higher sequence number i becoming progressively lower.

The sub-electrodes of the stationary electrode 31 are driven as explained with reference to FIG. 1, using inverting elements. The device operates as follows.

Electric signals of frequencies lower than $f_5$ are applied to all the transducers (sub-electrodes). Consequently, the entire diaphragm 30 will perform an excursion. It is evident that as the frequency of the input signal increases transducers (sub-electrodes) with decreasing sequence numbers are muted or attenuated. When the output signal has a frequency above $f_1$ only the upper section 32.1 will radiate.

The arrangement of the device as illustrated in FIGS. 2 and 3 is such that the higher frequencies are radiated at the upper side of the transducer, so that the advantages of a conventional multi-way system (comprising a tweeter in the upper part of the enclosure) are maintained.

Figure 4:
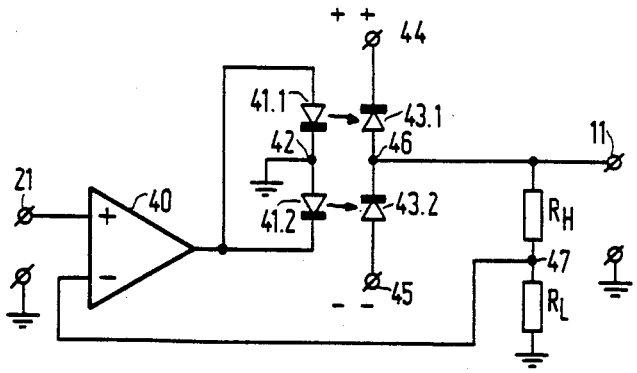
FIG. 4 is a circuit diagram of a high-voltage amplifier for use in the device.

FIG. 4 shows a high-voltage amplifier which is suitable for use as a sub-amplifier in the embodiments shown in FIG. 1 or FIGS. 2, 3. The high-voltage amplifier shown is known per se and is described inter alia in U.S. Pat. No. 4,673,864 (6/16/87), in particular with reference to FIG. 13 thereof.

The amplifier described therein may be used for the sub-amplifier 15 in FIG. 1. The input 21 of the sub-amplifier is coupled to the non-inverting input (+) of a differential amplifier 40, whose output is coupled to both ends of a series arrangement of 2p ($p \geqq 1$) light-emitting diodes. FIG. 4 shows a series arrangement of two light-emitting diodes 41.1 and 41.2. The centre tap 42 is coupled to a point of constant potential (ground). Each of the 2p light-emitting diodes cooperates optically with an associated light-sensitive semiconductor element of a series arrangement of 2p of such semiconductor elements. The Figure again shows two semiconductor elements 43.1 and 43.2. The series arrangement of the light-sensitive semiconductor elements is coupled to a second point 44 of constant potential (a positive high voltage of the order of 1 or more kV, depending on the reverse voltage that can be handled by the light-sensitive semiconductor elements) and a third point 45 of constant potential (a negative high voltage of the order of magnitude of 1 or more kV).

The centre tap is coupled to the output 11 of the sub-amplifier and is also coupled to the first point of constant potential (ground) via a series arrangement of the impedances $R_H$ and $R_L$. The junction point 47 between the impedances $R_H$ and $R_L$ is coupled to the inverting input (−) of the differential amplifier. The advantage of this amplifier arrangement is that there is an isolation between the high-voltage supply and the driving unit (being the differential amplifier 40). This means that a high-voltage drive can be obtained by means of low-voltage input signals.

It is to be noted that various modifications of the embodiments shown are possible within the scope of the invention as defined in the appended claims.

What is claimed is:

1. A device for converting an electric signal into an acoustic signal, comprising an input terminal for receiving the electric signal, an amplifier unit having an input coupled to the input terminal, and an output, and an electrostatic transducer unit coupled to the output of the amplifier unit, the electrostatic transducer unit comprising N electrostatic transducers, N being larger than or equal to 2, characterized in that the diaphragms of the N electrostatic transducers form part of a diaphragm which is common to all transducers, in that the amplifier unit comprises N sub-amplifiers, in that the input terminal is coupled to a first input of the first electrostatic transducer via a first sub-amplifier, the input terminal is coupled to a first input of the $(i+1)$th electrostatic transducer via a series arrangement of an i-th low-pass filter and an $(i+1)$th sub-amplifier (in this order), which $(i+1)$th sub-amplifier is of the feedback type, i ranging from 1 to $N-1$ inclusive, and in that if $N>2$ a low-pass filter of a higher sequence number i has a lower cut-off frequency.

2. A device as claimed in claim 1 wherein the electrostatic transducers are of the push-pull type, each comprising the respective said first input and a second input, characterized in that the input terminal is coupled to the second input of the first electrostatic transducer via an $(N+1)$th sub-amplifier, the gain factor in the circuit from the input terminal to the first input of the first transducer being substantially equal in magnitude to the gain factor in the circuit from the input terminal to the second input of the first transducer but having an opposite sign, in that the input terminal is coupled to the second input of the $(j+1)$th electrostatic transducer via a series arrangement of an $(N-1+j)$th low-pass filter and an $(N+1+j)$th sub-amplifier (in this order), which $(N+1+j)$th sub-amplifier is of the feedback type, the gain factor in the circuit from the input terminal to the first input of the $(j+1)$th transducer being substantially equal in magnitude to the gain factor of the circuit from the input terminal to the second input of the $(j+1)$th transducer but having an opposite sign, j ranging from 1 to $N-1$ inclusive.

3. A device as claimed in claim 2, characterized in that an inverting element is connected in each of the circuits from the input terminal to the second inputs of the transducers.

4. A device as claimed in claim 3, characterized in that the inverting elements are arranged before the $(N+1)$th to 2N-th sub-amplifiers.

5. A device as claimed in claim 2, characterized in that the $(N+1)$th sub-amplifier is the first sub-amplifier, the output of the first sub-amplifier is coupled to the second input of the first transducer via the inverting element, in that the $(N+1+j)$th sub-amplifier is the $(1+j)$th sub-amplifier and in that the output of the $(1+j)$th sub-amplifier is coupled to the second input of the $(1+j)$th transducer via the inverting element.

6. A device as claimed in claim 3 characterized in that the sub-amplifiers are high-voltage amplifiers.

7. A device as claimed in claim 2, characterized in that the transducers each comprise a first electrode arranged on the diaphragm and a second stationary electrode, in that the first electrodes of all the transducers form part of an electrode which is common to all transducers and which is arranged on the common diaphragm, and for this purpose are electrically interconnected, and in that the first inputs of the transducers are electrically coupled to the second electrodes of the respective transducers.

8. A device as claimed in claim 7, characterized in that the transducers each comprise a third stationary electrode which is arranged at that side of the diaphragm which is remote from the second electrode, and in that the second inputs of the transducers are electrically coupled to the third electrodes of the respective transducers.

9. A device as claimed in claim 1 wherein the transducers each comprise a first electrode arranged on the diaphragm and a second stationary electrode in that the first electrodes of all the transducers form part of an electrode which is common to all transducers and which is arranged on the common diaphragm, and for this purpose are electrically interconnected, and in that the first inputs of the transducers are electrically coupled to the second electrodes of the respective transducers.

* * * * *